US012460642B2

(12) United States Patent
Falkus et al.

(10) Patent No.: US 12,460,642 B2
(45) Date of Patent: Nov. 4, 2025

(54) DEVICES FOR COMPRESSING A GASEOUS FLUID AND METHOD OF OPERATING A DEVICE FOR COMPRESSING A GASEOUS FLUID

(71) Applicant: Hanon Systems, Daejeon (KR)

(72) Inventors: Erik-Florian Falkus, Burscheid (DE); Ayhan Ayar, Cologne (DE); Oliver Fischer, Würselen (DE); Nikolaos Mazitzis, Elsdorf (DE)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/846,944

(22) PCT Filed: Jun. 9, 2023

(86) PCT No.: PCT/KR2023/007913
§ 371 (c)(1),
(2) Date: Sep. 13, 2024

(87) PCT Pub. No.: WO2024/025137
PCT Pub. Date: Feb. 1, 2024

(65) Prior Publication Data

US 2025/0188933 A1 Jun. 12, 2025

(30) Foreign Application Priority Data

Jul. 27, 2022 (DE) ..... 102022118855.8
May 15, 2023 (DE) ..... 102023112736.5

(51) Int. Cl.
*F04C 29/00* (2006.01)
*F04C 18/02* (2006.01)

(52) U.S. Cl.
CPC ..... *F04C 29/00* (2013.01); *F04C 18/02* (2013.01); *F04C 2210/22* (2013.01); *F04C 2240/30* (2013.01)

(58) Field of Classification Search
CPC .. F04C 18/02; F04C 18/0215; F04C 18/0253; F04C 2210/22; F04C 2240/30;
(Continued)

(56) References Cited

U.S. PATENT DOCUMENTS 4,506,423 A * 3/1985 Nakamura ..... F25B 41/30 251/126
10,527,041 B2 * 1/2020 Moon ..... F04C 29/028
(Continued)

FOREIGN PATENT DOCUMENTS

CN 216342814 U * 4/2022
DE 102019101855 A1 3/2020
(Continued)

*Primary Examiner* — Jesse S Bogue
(74) *Attorney, Agent, or Firm* — Shumaker, Loop & Kendrick, LLP; James D. Miller

(57) ABSTRACT

Devices for compressing a gaseous fluid each have a housing with a cylindrical cavity configured in the housing, in which a spiral nozzle assembly is arranged. As such, the spiral nozzle assembly is configured with a spirally revolving winding with a winding surface, which at least partially sealingly abuts an inner wall of the cylindrical cavity. Recesses configuring a filter function and a bypass function are arranged on the winding surface of the spirally revolving winding, or the winding surface of the spirally revolving winding is arranged to be spaced apart from the inner wall of the cylindrical cavity with a distance configuring a gap for a filter function and a bypass function in at least one partial area. Additionally thereto, or instead thereof, recesses configuring a filter function are each arranged on a collar surface of a collar connected to the spiral nozzle assembly.

14 Claims, 5 Drawing Sheets

(58) Field of Classification Search
CPC .. F04C 2240/80; F04C 2280/02; F04C 29/00; F04C 29/0021; F04C 29/12
See application file for complete search history.

(56) References Cited

U.S. PATENT DOCUMENTS

| | | | | |
|---|---|---|---|---|
| 11,193,487 | B2 * | 12/2021 | Gutberlet | F04C 18/0246 |
| 11,286,936 | B2 * | 3/2022 | Kim | F04C 18/0215 |
| 11,448,218 | B2 * | 9/2022 | Lässer | F04C 29/0057 |
| 2024/0200837 | A1 * | 6/2024 | Gehm | F04C 29/028 |
| 2024/0369062 | A1 * | 11/2024 | Ayar | F04C 18/0253 |

FOREIGN PATENT DOCUMENTS

| | | | | | |
|---|---|---|---|---|---|
| DE | 102023117639 | A1 * | 2/2024 | | B05B 15/50 |
| JP | 2002168183 | A | 6/2002 | | |
| JP | 2009041429 | A | 2/2009 | | |
| JP | 2009209820 | A | 9/2009 | | |
| JP | 2018025124 | A * | 2/2018 | | F04C 18/344 |

* cited by examiner

DEVICES FOR COMPRESSING A GASEOUS FLUID AND METHOD OF OPERATING A DEVICE FOR COMPRESSING A GASEOUS FLUID

CROSS REFERENCE TO RELATED PATENT APPLICATIONS

This is a U.S. national phase patent application of PCT/KR2023/007913 filed Jun. 9, 2023 which claims the benefit of and priority to German Patent Application No. DE 10 2023 112 736.5 filed on May 15, 2023 and German Patent Application No. DE 10 2022 118 855.8 filed on Jul. 27, 2022, the entire contents of each of which are incorporated herein by reference for all purposes.

TECHNICAL FIELD

The invention relates to a device for compressing a gaseous fluid, in particular a scroll compressor for an air-conditioning system of a motor vehicle, more specifically a refrigerant compressor, in which a spiral nozzle assembly is arranged in a cylindrical cavity incorporated into a housing. The spiral nozzle assembly has a spirally revolving winding with multiple revolutions and a winding surface. The winding surface of the winding is at least partially arranged to sealingly abut an inner wall of the cylindrical cavity.

The invention also relates to a method of operating a device for compressing a gaseous fluid, in particular a scroll compressor for an air-conditioning system of a motor vehicle, more specifically a refrigerant compressor.

BACKGROUND ART

Prior-art compressors for mobile applications, in particular for air-conditioning systems of motor vehicles, for conveying refrigerant through a refrigerant circuit, also referred to as refrigerant compressors, are often configured as variable-displacement piston compressors or as scroll compressors irrespective of the refrigerant. As such, the compressors are driven either via a pulley or electrically.

In addition to a housing, conventional scroll compressors have an immovable, stationary stator with a disk-shaped base plate and a spiral wall extending from one side of the base plate as well as a movable orbiter also with a disk-shaped base plate and a spiral wall extending from a front side of the base plate. The stator and the orbiter cooperate. As such, the base plates are arranged relative to one another such that the spiral walls engage with one another. The orbiter is moved on a circular path by means of an eccentric drive.

The scroll compressors belonging to the prior art also have a wall which is arranged within the housing and firmly connected to the housing and which is configured as a boundary of a counter pressure area and is consequently also referred to as a counter wall. Due to the counter pressure present within the counter pressure area configured between the counter wall and the orbiter, in particular a rear side of the base plate of the orbiter, the orbiter is pressed with a force acting in the axial direction against the stator fixed to the housing, just as the counter wall. The pressure force acting in the axial direction is controlled or regulated by the counter pressure present within the counter pressure area, also referred to as a contact pressure. As such, as an intermediate pressure or medium pressure, the level of the contact pressure is between the levels of the high pressure as the outlet pressure and the low pressure as the suction pressure of the compressor.

The areas acted upon by high pressure and counter pressure, as well as by counter pressure and low pressure, are connected to one another via flow ducts configured in the housing or in the interior of the drive shaft with integrated expansion devices, for example.

The counter pressure is generated by means of a mass flow of the refrigerant, which is regulated by the expansion device, in particular a control valve, also referred to as a counter pressure valve, in combination with a spiral nozzle. The spiral nozzle has a reduced flow cross-section, as a result of which there is the risk that particles present in the refrigerant will deposit in and thus block a flow duct of the spiral nozzle. Such a blockage can lead to malfunctions of the compressor, for example to errors in the pressure regulation, and reduce the efficiency of the operation of the refrigerant compressor.

To avoid the blockages of the flow duct of the spiral nozzle as well as the associated malfunctions, filters are conventionally employed, in particular in electrically driven refrigerant compressors of air-conditioning systems in motor vehicles. Such a filter is arranged upstream of the spiral nozzle in the direction of flow of the refrigerant to filter out the particles creating the blockage of the flow duct from the mass flow of the refrigerant.

DE 10 2019 101 855 A1 discloses a scroll compressor, in particular for use in air-conditioning systems of motor vehicles, with an oil return unit. Therein, gaseous refrigerant is drawn in from a suction pressure chamber between a stationary stator and a movable orbiter and compressed into a high-pressure chamber. Additionally, the counter pressure chamber, which is also limited by the orbiter, is configured. By the counter pressure present in the counter pressure chamber, the orbiter is pressed against the stationary stator, also to create a force equilibrium to allow for a movement of the orbiting spiral within the stationary spiral with minimum friction.

Within a housing of the compressor, in particular within a central housing, a suction pressure spiral nozzle is arranged, having a cylindrical cavity, preferably configured as a cylinder bore, with a spiral nozzle assembly arranged therein. The spiral nozzle assembly interacts with the wall of the cylindrical cavity such that the spiral nozzle is configured between the surface of the spiral nozzle assembly and the wall of the cylindrical cavity. As such, the surface of the spiral nozzle assembly has a spiral groove, which is also referred to as a winding and forms a spiral flow duct or throttle duct in the area of contact of the spiral nozzle assembly with the wall of the cylindrical cavity.

Such refrigerant compressors configured as scroll compressors with a spiral nozzle assembly conventionally have the filter in the direction of flow of the refrigerant upstream of the spiral nozzle to avoid a blockage of the flow duct of the spiral nozzle. It is known that filters, for example with a mesh size of 125 μm, are employed for this purpose.

The use of such an additional filter requires corresponding additional installation space, at least one corresponding assembly step for arranging the filter and thus additional costs in the manufacture of the compressor.

In practice, it has been found that, due to it not being possible to achieve complete cleanness of the production process and assembly process during the manufacture of refrigerant compressors, for example, impurities or particles, such as chips, can reach the areas passed through by the refrigerant. These impurities can lead to blockages in an inlet area of the spiral nozzle and thus in an area with a start of the spiral winding of the spiral nozzle assembly.

Consequently, there is a need for an improved refrigerant compressor for air-conditioning systems and an improved method of operating a refrigerant compressor.

SUMMARY

The object of the invention is to provide a device for compressing a gaseous fluid, in particular a refrigerant compressor for an air-conditioning system of a motor vehicle, as well as a method of operating a corresponding device for compressing a gaseous fluid, thanks to which a reliable functioning or a safe operation is achieved. As such, the effort involved in the manufacture and operation of the device as well as the associated costs, the required installation space and the number of components should be minimal.

The object is achieved by the subject-matters having the features as shown and described herein.

The object is achieved by means of devices according to the invention for compressing a gaseous fluid, in particular a scroll compressor for compressing a refrigerant circulating within a refrigerant circuit, more specifically a refrigerant compressor. The device has both a housing and a compression mechanism with a stationary stator as well as a movable orbiter.

A spiral nozzle assembly is arranged in a cylindrical, in particular circular-cylindrical, cavity configured in the housing and has a spirally revolving winding with multiple revolutions and a winding surface. The winding surface of the winding is at least partially arranged such that the winding surface sealingly abuts an inner wall of the cylindrical cavity. As such, the winding surface preferably sealingly abuts the inner wall of the cylindrical cavity across the entire length of the winding.

In an inlet area, the spiral nozzle assembly may also be configured with an, in particular circular-cylindrical, collar which sealingly abuts the inner wall of the cylindrical cavity with a collar surface facing in the radial direction. The collar is arranged on the spiral nozzle assembly in the direction of flow of the fluid through the spiral nozzle assembly in an area upstream of the spiral winding. The inlet area relates to the area through which the fluid flows into the cylindrical cavity with the spiral nozzle assembly and thus into the spiral nozzle.

The spiral winding has a plurality of revolutions configured along the outside of the spiral nozzle assembly, starting with a first revolution at the inlet area of the cylindrical cavity or the spiral nozzle. A plurality is understood to mean a number of at least two.

With the winding arranged on the spiral nozzle assembly, spirally wound or revolving and at least partially tightly abutting the inner wall of the cylindrical cavity with the winding surface, the mass flow of the fluid is guided through a flow duct configured between adjacent revolutions of the winding and likewise spirally revolving when flowing through the spiral nozzle. As such, the fluid flows from an inlet side of the spiral nozzle or the spiral nozzle assembly to an outlet side of the spiral nozzle. The outlet side of the cylindrical cavity of the spiral nozzle is preferably configured in the shape of a nozzle.

In the inlet area of the spiral nozzle, in which the spirally wound winding of the spiral nozzle assembly begins, means for the bypass function are arranged according to the invention, which make it possible to maintain the mass flow of the fluid through the spiral nozzle, in particular through the spiral flow duct configured between adjacent revolutions of the spiral winding, in the event of a blockage occurring in the inlet area of the spirally wound winding.

The means for configuring the bypass function simultaneously fulfil a filter function for filtering impurities from the mass flow of the fluid in the inlet area of the spiral nozzle.

In a first device according to the invention, recesses configuring a filter function and a bypass function are arranged on the winding surface of the spirally revolving winding and/or recesses configuring a filter function are arranged on the collar surface of the collar connected to the spiral nozzle assembly. Preferably, the recesses each have the form of slots, each extending between two adjacent free volumes acted upon by the fluid and connecting the volumes to one another.

To fulfil the bypass function, multiple recesses are configured on the winding surface of the winding, in particular at the start of the spirally revolving winding or on the winding surface of a first revolution of the spirally revolving winding and thus in the inlet area of the spiral nozzle. The recesses, which advantageously extend parallel to a central axis or axis of symmetry of the cylindrical cavity or to a longitudinal axis of the spiral nozzle assembly, in connection with the inner wall of the cylindrical cavity, each represent a bypass for the fluid through the normally sealed area between the winding surface of the winding and the inner wall of the cylindrical cavity and thus to the spirally revolving flow duct. The recesses within the winding surface each permit the fluid to flow over from the inlet area into a first area of the flow duct configured between two adjacent revolutions of the winding or between two adjacent sections of the flow duct of the spiral nozzle also between adjacent revolutions of the winding as a bypass function.

As such, the bypass function serves to pass the fluid through the spiral nozzle even when impurities are present within the fluid, for example chips, which lead to a blockage of the spiral nozzle in the inlet area or at the start of the spiral winding. As a result, malfunctions or failures of the device caused by such blockages are avoided and the operation of the device is also ensured when such a blockage occurs.

Due to the dimensions, the means for the bypass function configured as recesses also fulfil the filter function in addition to the bypass function when a blockage occurs, since particles contained in the fluid which exceed a size predetermined based on the dimensions of the recesses cannot pass through the flow cross sections configured by the recesses in connection with the inner wall. The corresponding particles are prevented from flowing through the flow cross sections and are thus filtered out of the mass flow of the fluid.

According to a preferred embodiment of the invention, the recesses configured on the winding surface of the first revolution of the winding are arranged across an area of a circular arc of the first revolution and thus in a section of the first revolution of the winding. As such, the recesses can also be configured along the entire circumference of the first revolution of the winding. Additionally, groups with a certain number of recesses can also be arranged in various circular arcs or sections of the first revolution of the winding. Thus, the area in which the recesses are arranged can comprise the entire first revolution or a circular arc or multiple circular arcs in the area of the first revolution.

Alternatively or additionally, the filter function is made possible by the configuration of a plurality of recesses on the collar surface of the collar connected to the spiral nozzle assembly. The recesses preferably extend parallel to the center axis or axis of symmetry of the cylindrical cavity or to the longitudinal axis of the spiral nozzle assembly.

The collar provided in the inlet area of the spiral nozzle or of the spiral nozzle assembly preferably has the shape of a circumferential ring, which sealingly abuts the inner wall of the cylindrical cavity with the circumferential collar surface.

A further advantage of the invention is that the recesses arranged to be distributed across the circumference of the circumferential collar surface of the collar are arranged to be distributed in a partial area of the circumference of the collar, in particular in the area of a circular arc, or across the entire circumference of the collar. Alternatively, recesses in the area of multiple circular arcs can be distributed across the circumference of the circumferential collar surface or groups with a certain number of recesses can be arranged in various circular arcs or sections of the circumference of the circumferential collar surface.

The filter function of such a collar is alternatively assured across a defined distance between the circumferential collar surface and the inner wall of the cylindrical cavity. Since the outer diameter of the collar is slightly smaller than the inner diameter of the inner wall of the cylindrical cavity, a gap is configured which effects a filter function and the dimensions of which are in the range from 0.01 mm to 0.30 mm.

In a further device according to the invention, the winding surface of the spirally revolving winding is arranged in at least one partial area at a distance from the inner wall of the cylindrical cavity, configuring a gap.

As such, the partial area of the winding surface of the spirally revolving winding, which is arranged at a distance from the inner wall of the cylindrical cavity, preferably comprises an angular range of 0° to 360° and thus at least the first revolution or only a section of the angular range of 0° to 360° of the first revolution of the winding. As such, embodiments with an angular range of 0° to 720° or more are also conceivable, which may thus comprise up to at least two revolutions of the revolving winding. The gap configured between the winding surface of the spirally revolving winding and the inner wall of the cylindrical cavity can become smaller or remain constant in the inlet area of the spiral nozzle as the distance from the start of the winding increases. A gap configured in this manner enables both a bypass function in the event of a blockage in the inlet area of the spiral nozzle assembly and a filter function for retaining particles of a certain size.

The distance configured in particular in the area of the first revolution of the winding between the winding surface and the inner wall of the cylindrical cavity can be in a range from 0.001 mm to 0.250 mm.

According to an advantageous embodiment of the invention, the gap extends across the entire circumference of the first revolution with an unchanged, constant distance between the winding surface of the spirally revolving winding and the inner wall of the cylindrical cavity.

Alternatively, the distance of the gap along the first revolution of the winding is configured to become smaller, so that the gap at the start of the winding in the inlet area of the spiral nozzle and thus at the start of the first revolution of the winding has a distance of 0.1 mm between the winding surface of the spirally revolving winding and the inner wall of the cylindrical cavity. In the direction of the course of the first revolution, the distance of the gap decreases to 0 mm, so that the winding surface, for example, completely and sealingly abuts the inner wall of the cylindrical cavity at the end of the first revolution and thus at the start of a second revolution of the winding.

As such, the course of the decrease in the distance of the gap can be continuous or ramped. The ramped configuration is to be understood as a configuration of sections along the winding surface with a constant distance within the corresponding section.

According to a development of the invention, the size of the gap distance is configured to change in a ramp shape in a range from 0.20 mm to 0 mm, in particular in a range from 0.08 mm to 0 mm, or the gap distance has an unchanged size in a range between 0.01 mm and 0.20 mm, in particular in a range from 0.08 mm to 0.20 mm.

The sizing of the distance of the gap assures that the fluid flows through the gap so that the mass flow of the fluid through the spiral nozzle is ensured, while at the same time correspondingly large impurities in the fluid are retained by the gap.

In addition to the spaced configuration of the winding surface of the spirally revolving winding of the spiral nozzle assembly relative to the inner wall of the cylindrical cavity, the filter function can again be fulfilled by the configuration of multiple recesses on the collar surface of the collar connected to the spiral nozzle assembly. In turn, the recesses preferably extend parallel to the center axis or axis of symmetry of the cylindrical cavity or to the longitudinal axis of the spiral nozzle assembly and can be configured as described above.

The dimensions of the recesses provided on the collar surface are also each selected such that particles exceeding a predetermined size are prevented from passing through between the recesses and the inner wall of the cylindrical cavity and are thus retained or filtered.

According to a development of the invention, the recesses configured within the winding surface or the collar surface each have a semicircular, rectangular, trapezoidal or triangular cross section. The various recesses can be incorporated into the winding surface of the winding and/or the collar surface by means of various methods. To enable the bypass function, the cross section of the recesses is each selected to be so large that a desired mass flow of the fluid is assured by the flow cross section configured by the recesses in connection with the inner wall of the cylindrical cavity. As such, the flow cross section and thus the cross section of the recesses are also selected to be so small that the particles with a predetermined minimum size are retained or filtered and thus the filter function is fulfilled.

The recesses advantageously have a width in the range from 0.01 mm to 0.02 mm and a depth in the range from 0.008 mm to 0.01 mm. The dimensions of the recesses allow the fluid to pass through the recesses, while at the same time correspondingly large impurities are retained in the fluid.

With the dimensions or the sizing and the arrangement, the recesses each fulfil a filter function and do not allow particles contained in the fluid, which exceed a predetermined level of the dimensions, to pass.

The invention comprises any combinations of the embodiments described for configuring the filter function and the bypass function. Thus, for example, an arrangement of the collar with the recesses is combined with recesses arranged in the area of the first revolution of the spiral winding. An alternative has the arrangement of the collar with the recesses in combination with the gap arranged in the area of the first revolution, wherein the gap can be configured with a constant distance or a distance varying across the length and thus the course of the winding, starting in the inlet area. The respective combinations further improve the filter function in particular.

The object is also achieved by a method of operating a device for compressing a gaseous fluid, in particular a scroll compressor for an air-conditioning system of a motor vehicle.

In the method, in a cylindrical cavity incorporated in a housing, a spiral nozzle assembly is provided which has a spirally revolving winding with a winding surface, wherein the winding surface of the winding is at least partially arranged to sealingly abut an inner wall of the cylindrical cavity, and wherein a mass flow of the fluid in the spiral nozzle assembly is passed through a spirally configured flow duct between the revolutions of the winding.

In an area of the winding surface of the winding, a bypass function and a filter function are provided. In addition thereto, or instead thereof, a filter function is provided in an area of a collar surface of a collar configured on the spiral nozzle assembly, wherein the mass flow of the fluid is ensured by means of the bypass function through the spiral flow duct also when the revolving winding in the inlet area becomes blocked, and particles contained in the fluid which exceed a predetermined size are filtered out of the mass flow of the fluid by means of the filter function.

Thus, in comparison to conventional devices and methods, the function of the device is also ensured in the event of a blockage of the revolving winding in an inlet area as well as a mass flow of the fluid through the flow duct of the spiral nozzle.

For the event of such a blockage, the bypass function is configured which enables continued mass flow of the fluid. With the filter function, particles contained in the fluid which exceed a predetermined size are retained or filtered. The filter function is configured in the area of the winding surface of the winding of the spiral nozzle. In the event that a collar is configured on the spiral nozzle assembly, the filter function is also configured in the area of the collar surface.

According to a development of the invention, the filter function is configured by means of multiple recesses provided on the winding surface of the winding and/or the collar surface of the collar.

By arranging a plurality of recesses on the winding surface of the winding, which are correspondingly shaped and sized, the particles of corresponding size are filtered. The arrangement of the recesses and thus the filtering take place in the area of the first revolution of the spiral winding.

In the event that a collar is arranged on the spiral nozzle assembly and recesses are attached to the collar surface and correspondingly sized, the fluid is filtered in the area of the collar at the inlet of the cylindrical cavity.

According to a preferred embodiment of the invention, the bypass function for maintaining the mass flow of the fluid through the spiral nozzle is enabled by means of multiple recesses configured on the winding surface of the winding.

In the event of a blockage of the spiral nozzle in the inlet area of the revolving winding which obstructs the mass flow of the fluid, the bypass function for bypassing the blockage is provided by the multiple recesses provided on the winding surface of the winding. As such, the fluid flows through the recesses and the subsequent non-blocked spiral sections of the flow duct of the spiral nozzle and thus ensures the mass flow of the fluid and the function of the spiral nozzle or the device.

Alternatively, the bypass function for maintaining the mass flow of the fluid through the spiral nozzle can be enabled by means of a gap configured between the winding surface of the winding and the inner wall of the cylindrical cavity at least partially along the winding surface.

In the event of a blockage in the inlet area of the revolving winding which obstructs the mass flow of the fluid, alternatively, the bypass function for bypassing the blockage is provided by the gap at least partially configured between the inner wall of the cylindrical cavity and the winding surface. As such, the fluid flows through the gap and the subsequent non-blocked spiral areas of the flow duct and thus ensures the mass flow of the fluid and the function of the spiral nozzle or the device.

The advantages of the device according to the invention for compressing the gaseous fluid, in particular the refrigerant compressor for a refrigerant circuit of an air-conditioning system of a motor vehicle, and of the method of operating a device for compressing the gaseous fluid can be summarized as follows:

- reliable functioning or safe operation by enabling a bypass mass flow and filtration of particles of critical size from the mass flow of the fluid, thereby avoiding blockages, in particular in the area of the spiral nozzle,
- without additional components, such as a filter element, with minimal installation space, and
- minimum production and operation effort as well as associated minimum costs.

DESCRIPTION OF DRAWINGS

Further details, features, and advantages of embodiments of the invention will become apparent from the following description of exemplary embodiments with reference to the accompanying drawings. In the drawings.

DESCRIPTION OF AN EMBODIMENT

Figure 1:
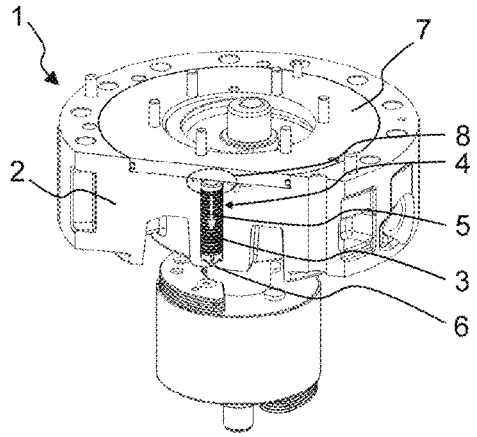
FIG. 1: shows a perspective view of a detail of an electrically driven refrigerant compressor.

FIG. 1 shows a perspective view of a detail of a device 1, in particular an electrically driven refrigerant compressor.

In a cylindrical cavity 4 configured in the housing 2 of the device 1, a spiral nozzle assembly 3 is arranged. The main flow direction 5 of the mass flow of the refrigerant flowing through the spiral nozzle assembly 3 as a fluid to be compressed is represented by an arrow. As such, the refrigerant flows from an inlet area 8 towards an end 6 of the cylindrical cavity 4 which is arranged distally from the inlet area 8 and is configured in the form of a nozzle. The inlet area 8 configured in the area of a so-called friction plate 7 of the housing 2, is represented by a dash-dash line.

Figure 2:
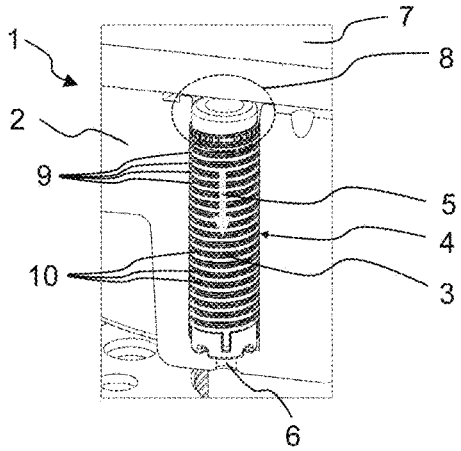
FIG. 2: shows an enlarged, perspective sectional view of the housing of the refrigerant compressor of FIG. 1, FIG. 3: shows a section of a spiral nozzle assembly of FIG. 2 with multiple recesses configured on the winding surface of the winding.
Figure 3:
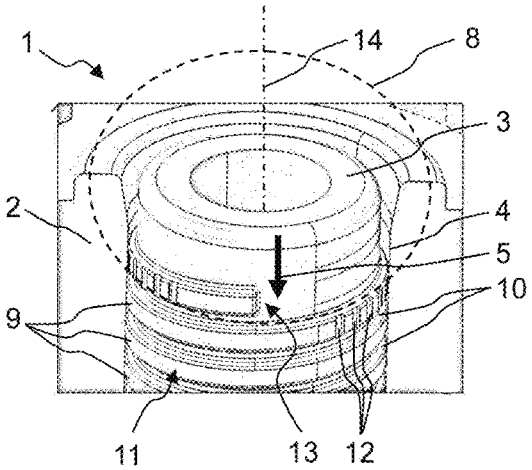

FIG. 2 shows an enlarged, perspective sectional view of the housing 2 of the device 1 of FIG. 1. FIG. 3 illustrates a section of the spiral nozzle assembly 3 of FIG. 2 with multiple slot-like recesses 12 configured on a winding surface 11 of the winding 9.

Blockages due to particles contained in the refrigerant can occur, in particular, in the inlet area 8 as well as at the nozzle-shaped end 6 of the cylindrical cavity 4 with the spiral nozzle assembly 3 with a spiral winding 9 incorporated into the cavity 4. A start 13 of the spiral winding 9 of the spiral nozzle assembly 3 is arranged in the inlet area 8. The spiral winding 9 of the spiral nozzle assembly 3 has a plurality of revolutions. Between adjacent revolutions, a continuous volume is configured as a spiral flow duct 10 for the refrigerant, through which the refrigerant is passed from the inlet area 8 to the end 6 of the cavity 4. The flow cross section of the flow duct 10 is limited by the winding 9 with its base on the one hand and the inner wall of the cylindrical cavity 4 on the other hand.

In the inlet area 8, in which the start 13, not shown in detail, of the spiral winding 9 of the spiral nozzle assembly 3 is arranged, the winding surface 11 of the winding 9 has multiple recesses 12, in particular on a first revolution. The recesses 12, which are configured with a semicircular cross section, each extend in the longitudinal direction parallel to a longitudinal axis 14 of the cylindrical cavity 4 which corresponds to a longitudinal axis 14 of the spiral nozzle assembly 3.

The configuration of the recesses 12 ensures that the refrigerant flowing into the spiral nozzle through the inlet area 8 flows through the recesses 12 configured with a bypass function past the blocked area of the flow duct 10 and into the flow duct 10 in the area of a second revolution following the first circulation in the event of a blockage of the flow duct 10 in the area of the first revolution of the spiral winding 9 which prevents the refrigerant from flowing into the flow duct 10.

This assures that the refrigerant flows through the flow duct 10 of the spiral nozzle up to the nozzle-shaped end 6 of the cavity 4 even in the event of a blockage of the flow duct 10 in the inlet area 8 of the spiral nozzle or at the start 13 of the spiral winding 9, and thus ensures the functioning of the spiral nozzle and consequently of the device 1.

The recesses 12 also fulfil a filter function for particles contained in the refrigerant. As such, the recesses 12 are sized such that particles exceeding a predetermined size are retained and are thus filtered out of the mass flow of the refrigerant through the spiral nozzle. Due to the size, the corresponding particles cannot pass through the flow cross sections configured by the recesses 12 in connection with the inner wall of the cavity 4.

Figure 4:
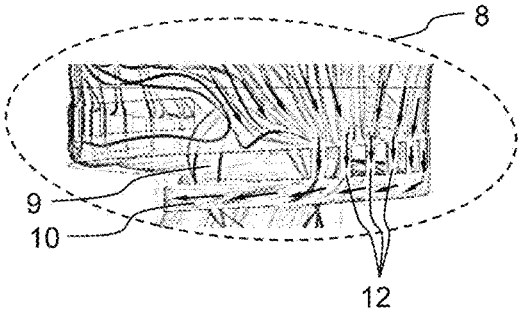
FIG. 4: shows flow conditions which arise in the inlet area of the spiral nozzle with configuration of the recesses.

FIG. 4 shows a schematic illustration of the flow conditions of the refrigerant which arise in the inlet area 8 of the spiral nozzle with configuration of the recesses 12. Various flow paths of the refrigerant are shown by way of example by a selection of flow arrows.

As such, in FIG. 4, the refrigerant is shown to flow into the inlet area 8 from above, in which a section of the winding 9 with the recesses 12 and a section of the flow duct 10 are shown.

Due to a blockage of the flow duct 10, the refrigerant flows through the recesses 12 with a bypass function at the start 13 of the winding 9 and past the first revolution of the winding 9 and into the flow duct 10 downstream of the first revolution of the winding 9.

Subsequently, the refrigerant flows in the flow duct 10 to the nozzle-shaped end 6 of the cylindrical cavity 4 and then out of the spiral nozzle.

Figure 5:
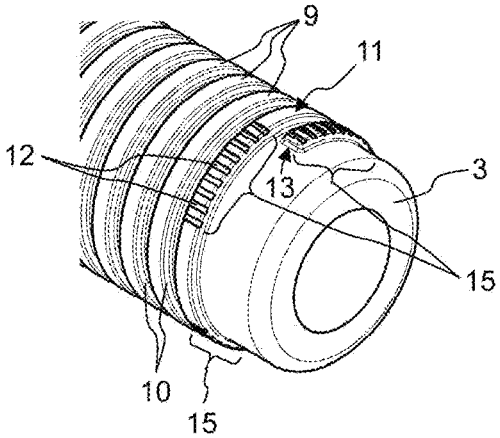
FIG. 5: shows a perspective view of the spiral nozzle assembly of FIG. 3 with multiple recesses arranged on the winding surface of the winding.

FIG. 5 shows a perspective view of the spiral nozzle assembly 3 of FIG. 3 with multiple recesses 12 arranged on the winding surface 11 of the winding 9. As such, FIG. 6 shows an enlarged sectional view of a partial area of the spiral nozzle assembly 3 of FIG. 5.

The spiral nozzle assembly 3 has the revolutions of the winding 9, which, starting along the surface of the spiral nozzle assembly 3, extend spirally at the start 13, as well as the spiral flow duct 10 configured between the revolutions of the winding 9. As such, multiple recesses 12 are provided on the winding surface 11 of the winding 9, in particular the first revolution of the winding 9.

The recesses 12 are each arranged in sections 15 on the winding surface 11 spaced apart from one another. As such, three such sections 15 are each configured with multiple recesses 12, in particular. Alternatively, on the one hand, a different number of sections or only one section can be configured. When a single section is configured, it can extend along the winding surface 11 of the entire first revolution of the winding 9.

Figure 6:
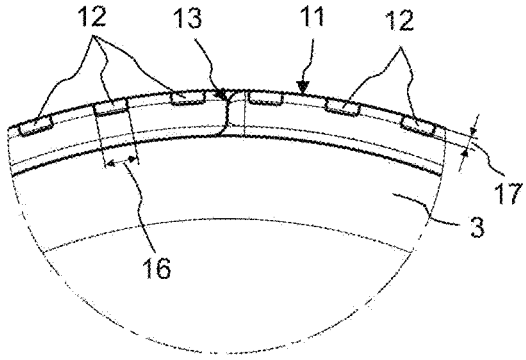
FIG. 6: shows an enlarged sectional view of a partial area of the spiral nozzle assembly of FIG. 5, FIG. 7: shows a perspective view of the spiral nozzle assembly with a gap arranged in the area of the first revolution, which remains at an unchanged distance.

According to FIG. 6, the recesses 12 have a rectangular cross section. In an exemplary embodiment, the recesses 12 are configured with a width 16 in the range from 0.02 mm to and a depth 17 of about 0.09 mm.

The two-dimensional filter defined with the width 16 and length or depth 17 serves to filter a set of particles of different sizes for each recess 12. As such, when the recesses 12 with the smallest flow cross section are blocked, a set of particles of different sizes can be filtered. The configuration of the recesses 12 can vary in number, width and depth.

Figure 7:
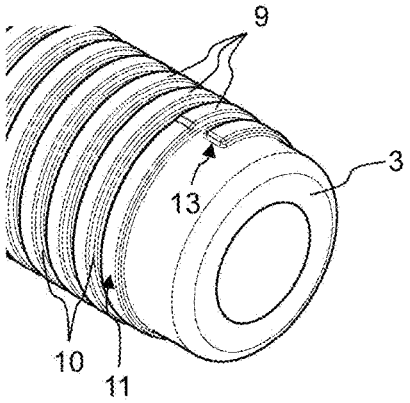
Figure 8:
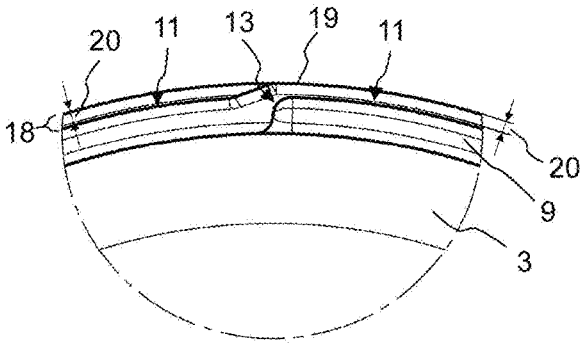
FIG. 8: shows an enlarged sectional view of a partial area of the spiral nozzle assembly of FIG. 7, FIG. 9: shows a perspective view of the spiral nozzle assembly with a gap arranged in the area of the first revolution, which decreases in distance.

FIGS. 7 and 8 show a perspective view of a spiral nozzle assembly 3 with a gap 18 arranged in the area of the first revolution of the winding 9 with a constant distance 20, as well as an enlarged sectional view of a partial area of the spiral nozzle assembly 3.

The first revolution of the spiral winding 9 has a smaller outer diameter than the section of the winding 9 following the first revolution. Thus, a gap 18 with a distance 20 unchanged or constant along the extension of the first revolution is configured between the winding surface 11 of the first revolution of the winding 9 and the inner wall 19 of the cylindrical cavity 4 surrounding the spiral nozzle assembly 3. The distance 20 between the winding surface 11 in the area of the first revolution of the winding 9 and the inner wall 19 of the cylindrical cavity 4 is in the range from 0.01 mm to 0.20 mm.

With a predetermined height as the distance 20 between the winding surface 11 and the inner wall 19 of the cylindrical cavity 4, the gap 18 enables the bypass function on the one hand, and the filter function for the refrigerant in the inlet area 8 of the spiral nozzle on the other hand, since the gap 18 allows the refrigerant to pass through on the one hand, and is configured to be so narrow as to retain particles contained in the refrigerant which exceed a predetermined size or to filter them out of the mass flow of the refrigerant on the other hand.

As such, when the flow duct 10 becomes clogged at the start 13 of the spiral winding 9, the refrigerant can flow through the gap 18 fulfilling the bypass function in the inlet area 8 and thus flow into the flow duct 10 in the area of the second revolution following the first revolution as well as be guided in the direction of the nozzle-like end 6, so that the function of the spiral nozzle is ensured.

According to FIG. 8, the gap 18 with the distance 20 remaining unchanged across the entire length extends only along the winding surface 11 of the first revolution of the winding 9.

Figure 9:
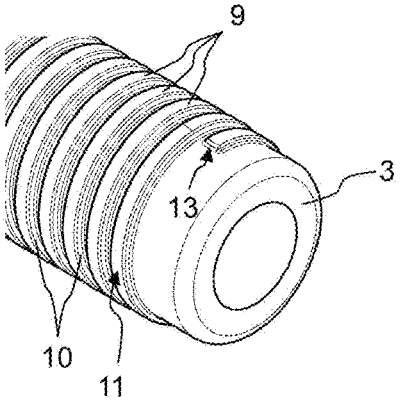
Figure 10:
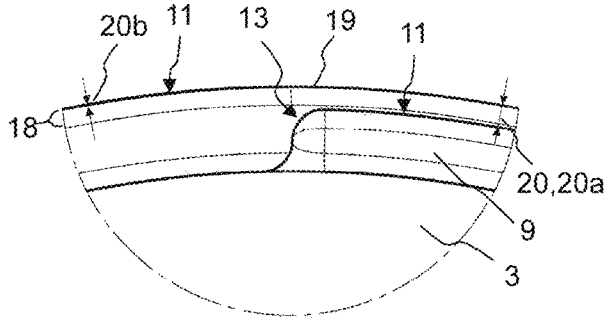
FIG. 10: shows an enlarged sectional view of a partial area of the spiral nozzle assembly of FIG. 9, FIG. 11: shows a perspective view of the spiral nozzle assembly with multiple recesses arranged on a collar surface of a collar.

FIGS. 9 and 10 show a perspective view of a spiral nozzle assembly 3 with a gap 18 arranged in the area of the first revolution of the winding 9, which decreases in distance 20, as well as an enlarged sectional view of a partial area of the spiral nozzle assembly 3.

The first revolution of the spiral winding 9 has an outer diameter changing along the revolution and each being smaller than the section of the winding 9 following the first revolution. Thus, a gap 18 with a distance 20 changing along the extension of the first revolution is configured between the winding surface 11 of the first revolution of the winding 9 and the inner wall 19 of the cylindrical cavity 4 surrounding the spiral nozzle assembly 3. The distance 20 between the winding surface 11 in the area of the first revolution of the winding 9 and the inner wall 19 of the cylindrical cavity 4 is in the range from 0.001 mm to 0.2 mm.

As such, the distance 20 of the gap 18 can be configured to be reduced continuously or ramp-like or gradually. With the gradual reduction of the distance 20, the winding surface 11 of the first revolution of the winding 9 is divided into sections in each of which the distance 20 is constant.

With the predetermined height as the distance 20 between the winding surface 11 and the inner wall 19 of the cylindrical cavity 4, the gap 18 enables the bypass function for the refrigerant in the inlet area 8 of the spiral nozzle, since the gap 18 allows the refrigerant to pass through. Additionally, the gap 18 enables the filter function for the refrigerant in the inlet area 8 of the spiral nozzle, since the gap 18 is configured to be so narrow as to retain particles contained in the refrigerant which exceed a predetermined size or to filter them out of the mass flow of the refrigerant.

As such, when the flow duct 10 becomes clogged at the start 13 of the spiral winding 9, the refrigerant can flow through the gap 18 fulfilling the bypass function in the inlet area 8 and thus flow into the flow duct 10 in the area of the second revolution following the first revolution as well as be guided in the direction of the nozzle-like end 6, so that the function of the spiral nozzle is ensured.

The refrigerant always takes the shortest path to flow to the end 6 of the spiral nozzle, so that the refrigerant flows through the gap 18 with the greater distance 20 in each case.

According to FIG. 10, the gap 18 with the distance 20 changing across the entire length extends only along the winding surface 11 of the first revolution of the winding 9. While the gap 18 at the start 13 of the winding 9 has a distance 20*a* of 0.2 mm, for example, the gap 18 at the end of the first revolution of the winding 9 has a distance 20*b* of 0.001 mm, for example. Additionally, embodiments are possible in which the configuration of the gap 18 with the distance 20 varying across the length of a revolution is repeated in a second revolution of the winding 9 and thus in a revolution of the winding 9 following the first revolution.

The continuous or gradual reduction of the distance 20 allows for a function of filtering fine particles. Since the refrigerant always flows along the shortest path, the refrigerant will flow through the next larger gap 18 when the gap 18 with the smallest distance 20 is blocked.

Figure 11:
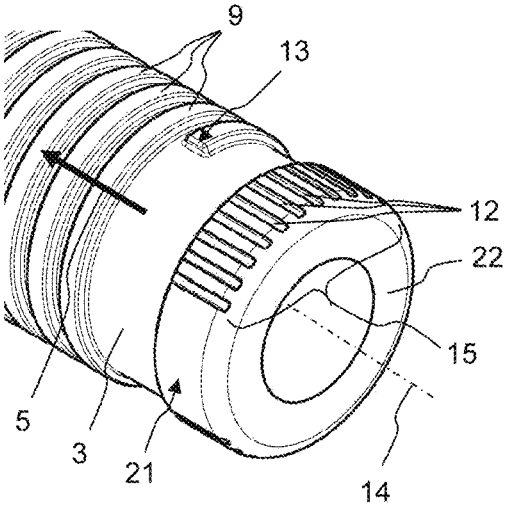

FIG. 11 shows a perspective view of a spiral nozzle assembly 3 with multiple recesses 12 arranged on a collar surface 21 of a collar 22.

In the inlet area 8 of the spiral nozzle, the spiral nozzle assembly 3 has the annular collar 22 with a circumferential collar surface 21 which sealingly abuts the inner wall 19 of the cylindrical cavity 4 (not shown). The collar 22 is arranged in the main flow direction 5 of the refrigerant through the spiral nozzle with the spiral nozzle assembly 3 upstream of the start 13 of the spiral winding 9.

The slot-like recesses 12 configured at least in a section 15 on the circumferential collar surface 21 each extend in the longitudinal direction parallel to the longitudinal axis 14 of the cylindrical cavity 4 (not shown), which corresponds to a longitudinal axis 14 of the spiral nozzle assembly 3.

The recesses 12 arranged on the collar surface 21 fulfil a filter function, since the recesses 12 are sized such that particles contained in the refrigerant and exceeding a predetermined size are retained or filtered out of the mass flow of the refrigerant.

FIGS. 12A to 12D show a perspective view of an overview of possible combinations of the configurations of the spiral nozzle assembly 3 and the collar 22.

Figure 12A:
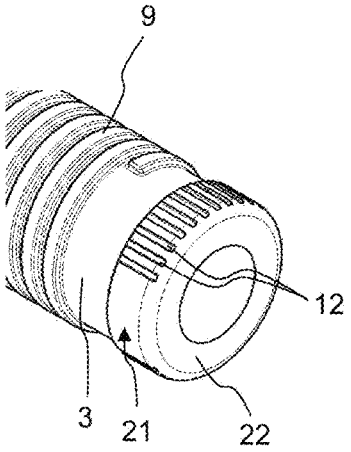
FIGS. 12A to 12D: show a perspective view of an overview of possible combinations of the configurations of the spiral nozzle assembly and the collar.

FIG. 12A shows the spiral nozzle assembly 3 of FIG. 11, which has the collar 22 with multiple recesses 12 configured on the circumferential collar surface 21 in the inlet area 8 of the spiral nozzle. In addition to the collar 22 with multiple recesses 12 configured on the circumferential collar surface 21, this spiral nozzle assembly 3 can also be configured with a modified winding surface 11 of the winding 9, in particular in the area of the first revolution of the winding 9, according to the embodiments according to FIGS. 7 to 10.

Figure 12B:
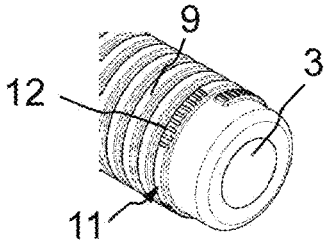

FIG. 12B shows the spiral nozzle assembly 3 with a configured collar 22 in combination with the configuration of multiple recesses 12 on the winding surface 11 of the first revolution of the winding 9 according to FIGS. 5 and 6.

Figure 12C:
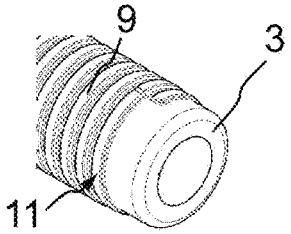

FIG. 12C shows the spiral nozzle assembly 3 with a collar 22 configured in combination with the configuration of the gap 18 with a distance 20 which remains unchanged across the area of the first revolution of the winding 9 according to FIGS. 7 and 8.

Figure 12D:
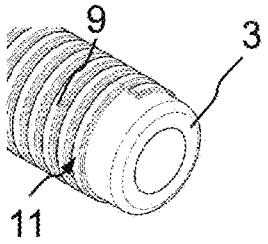

FIG. 12D shows the spiral nozzle assembly 3 with a collar 22 configured in combination with the configuration of the gap 18 with a distance 20 which decreases along the first revolution of the winding 9 according to FIGS. 9 and 10.

All embodiments of the recesses 12 and gaps 18 are conceivable from the start 13 of the spiral winding 9 with any desired extension on the winding surface 11 and thus on any desired number of revolutions. The sizing of the recesses 12 and gaps 18 in particular depends on the particles to be filtered and thus on the fulfilment of the filter function. To filter particles of different sizes, different shapes of the flow cross sections can be configured.

As such, the recesses 12 and gaps 18 are sized such that, as a control mass flow, the mass flow of the refrigerant is influenced only minimally.

Also conceivable are both combinations of the spiral winding 9 with recesses 12 and a collar 22 in various variants and in gradual variants with spiral configurations mounted one behind the other with recesses 12 in various geometrical positions.

The invention claimed is:

1. A device for compressing a gaseous fluid comprising a housing with a cylindrical cavity configured in the housing, in which a spiral nozzle assembly is arranged, wherein the spiral nozzle assembly has a spirally revolving winding with a winding surface, wherein the winding surface is at least partially arranged to sealingly abut an inner wall of the cylindrical cavity, wherein recesses configuring a filter function and a bypass function are arranged on the winding surface of the spirally revolving winding, and/or in that the recesses configuring a filter function are arranged on a collar surface of a collar connected to the spiral nozzle assembly.

2. The device according to claim 1, wherein multiple ones of the recesses are arranged on the winding surface in a section of a first revolution of the spirally revolving winding.

3. A device for compressing a gaseous fluid comprising a housing with a cylindrical cavity configured in the housing, in which a spiral nozzle assembly is arranged, wherein the spiral nozzle assembly has a spirally revolving winding with a winding surface, wherein the winding surface is at least partially arranged to sealingly abut an inner wall of the cylindrical cavity, wherein the winding surface of the spirally revolving winding is arranged to be spaced apart from the inner wall of the cylindrical cavity in at least one partial area with a distance configuring a gap for a filter function and a bypass function.

4. The device according to claim 3, wherein recesses configuring a filter function are arranged on a collar surface of a collar connected to the spiral nozzle assembly.

5. The device according to claim 3, wherein the at least one partial area of the winding surface of the spirally revolving winding further comprises an angle in a range from 0° to 720° of a revolution of the spirally revolving winding, or a section of a first revolution of the spirally revolving winding, wherein the gap has the distance decreasing or the distance constant to the inner wall of the cylindrical cavity each in the at least one partial area as the distance from a start of the spirally revolving winding in the inlet area increases.

6. The device according to claim 3, wherein a size of the distance of the gap changes in a ramp-like manner in a range from 0.20 mm to 0 mm, or wherein the distance of the gap has a constant size in a range from 0.01 mm to 0.20 mm.

7. The device according to claim 1, wherein the recesses have a semicircular, a rectangular, a trapezoidal or a triangular cross section.

8. The device according to claim 1, wherein the recesses have a width in a range from 0.01 mm to 0.02 mm and a depth in a range from 0.008 mm to 0.01 mm.

9. The device according to claim 1, wherein multiple ones of the recesses are arranged to be distributed on the collar surface in a partial area of a circumference of the collar or across an entire circumference of the collar.

10. A method of operating a device for compressing a gaseous fluid in which a spiral nozzle assembly is arranged in a cylindrical cavity configured in a housing, which has a spirally revolving winding with a winding surface, wherein the winding surface is at least partially arranged to sealingly abut an inner wall of the cylindrical cavity, and wherein a mass flow of the gaseous fluid in the spiral nozzle assembly is passed through a spiral flow duct configured between revolutions of the spirally revolving winding, wherein a bypass function and a filter function are provided in an area of the winding surface of the spirally revolving winding, and/or in that the filter function is provided in an area of a collar surface of a collar configured on the spiral nozzle assembly, wherein the mass flow of the gaseous fluid is ensured by means of the bypass function through the spiral flow duct when the spirally revolving winding becomes blocked in an inlet area, and wherein particles contained in the gaseous fluid which exceed a predetermined size are filtered out by means of the filter function.

11. The method according to claim 10, wherein the filter function is configured by means of multiple recesses configured on the winding surface of the spirally revolving winding and/or the collar surface of the collar.

12. The method according to claim 10, wherein the bypass function for maintaining the mass flow of the gaseous fluid is configured by means of multiple recesses configured on the winding surface of the spirally revolving winding.

13. The method according to claim 10, wherein the bypass function for maintaining the mass flow of the gaseous fluid is configured by means of a gap configured between the winding surface of the spirally revolving winding and the inner wall of the cylindrical cavity at least partially along the winding surface.

14. The method according to claim 13, wherein the gap is configured with a distance decreasing, as the distance from a start of the winding in the inlet area increases, or a constant distance, each from the inner wall of the cylindrical cavity.

* * * * *